United States Patent [19]

Gillilan

[11] 4,086,765

[45] May 2, 1978

[54] POWER GENERATING SYSTEM

[76] Inventor: James Gillilan, 4330 Howe Dr., Sherman, Tex. 75090

[21] Appl. No.: 767,814

[22] Filed: Feb. 11, 1977

[51] Int. Cl.[2] ..... F15B 1/00

[52] U.S. Cl. ..... 60/325; 60/327; 417/125

[58] Field of Search ..... 60/327, 325, 698; 417/125, 122, 118

[56] References Cited

U.S. PATENT DOCUMENTS

| | | | |
|---|---|---|---|
| 3,264,827 | 8/1966 | Siptrott | 60/325 |
| 3,829,246 | 8/1974 | Hancock | 417/121 |
| 3,941,509 | 3/1976 | Gillilan et al. | 417/54 |

*Primary Examiner*—Edgar W. Geoghegan

[57] ABSTRACT

A method and apparatus for generating energy are presented wherein fluid flowing from the base of a standpipe drives a power converter such as a turbine. The discharged fluid is recycled to the top of the standpipe by pumping chambers which are filled by the flowing fluid and then discharged by compressed air. The compressed air is derived from a storage tank which is pressurized partially by the pumping chambers as they are undergoing a fluid fill cycle.

8 Claims, 1 Drawing Figure

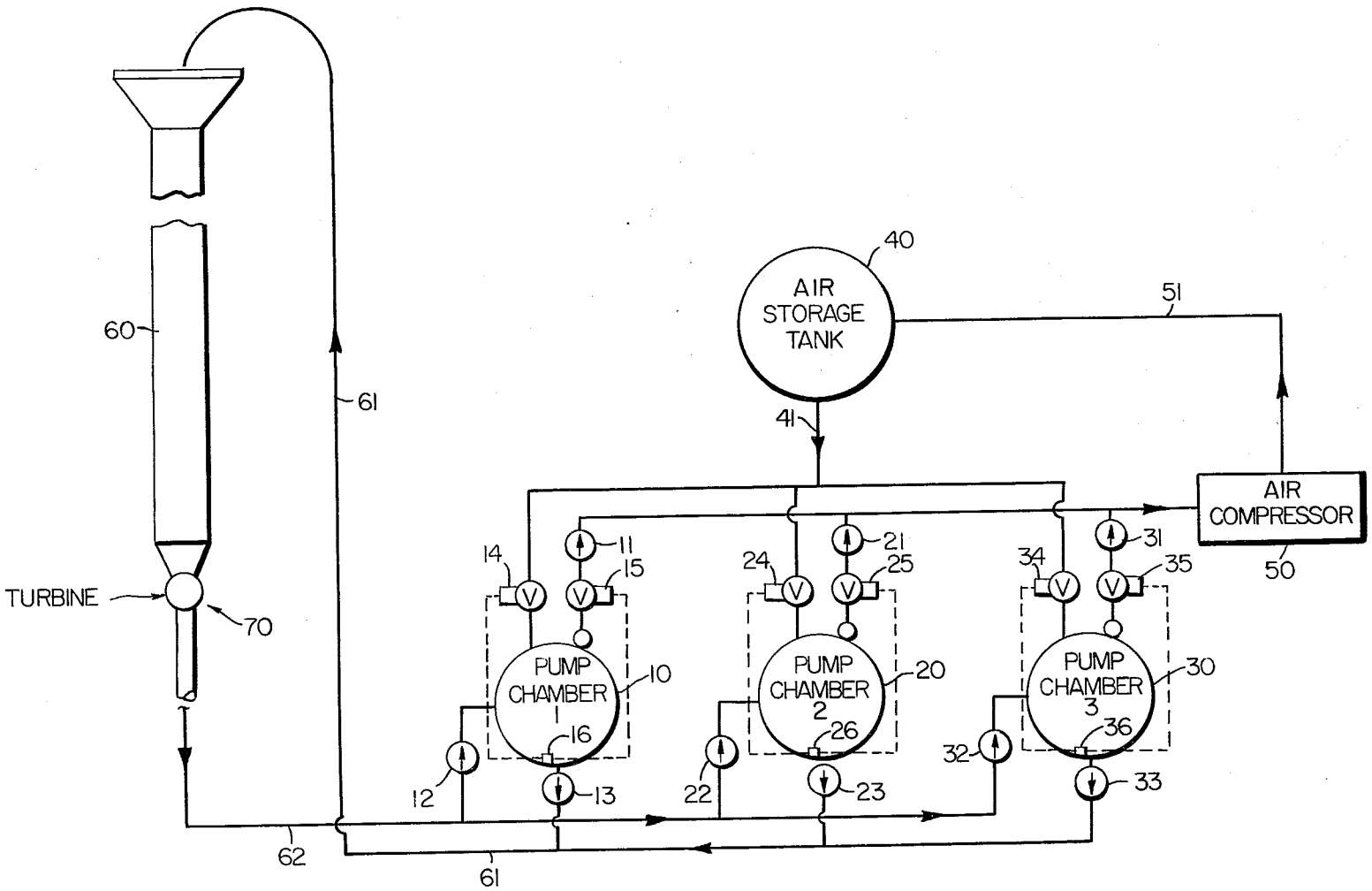
AIR COMPRESSOR
50
51
AIR STORAGE TANK
40
41
PUMP CHAMBER 1
10
PUMP CHAMBER 2
20
PUMP CHAMBER 3
30
11
12
13
14
15
16
21
22
23
24
25
26
31
32
33
34
35
36
61
62
60
70
TURBINE

POWER GENERATING SYSTEM

THE INVENTION

This invention relates to an energy conversion system of the type which utilizes a flowing fluid to drive a power converter or turbine in combination with air pressure pumping means adapted to recycle the turbine driving fluid.

BACKGROUND OF THE INVENTION

The ever increasing need of civilized man for power is rapidly depleting the worlds reserves of fossil fuels and requiring civilization to turn to other sources of energy. One of these sources is water which has been used as a source of energy for many years. It has been harnessed to drive mills and to provide a driving force for a large variety of mechanical devices during the industrial revolution. With the advent of electrical power it has provided the energy to drive turbines adapted to create electrical power for masses of people and industrial users. However, all of these uses for water to create energy in a more useable form demands that the water supply has a sufficient head of pressure and is of relatively inexhaustable volume because the discharge fluid from the power converters is lost to the system.

Some attempts have been made to recycle water but they provide a reclamation of only a small percentage of the total volume utilized. An example of such devices is presented in U.S. Pat. No. 3,829,246 issued to B. J. Hancock on Aug. 13, 1974 for "System for Raising And Using Water." In this system, water flowing from a pressure head is utilized to raise a portion of the water via vacuum means so that it may be recycled through a turbine. As previously suggested, systems similar to this lose most of the fluid and only a small portion is recycled.

One means to lessen the amount of fluid wasted in systems similar to those previously described would be to create a more energy conservative means to recycle the fluid. One means of conserving energy in recycling fluids which has met with some success is presented in U.S. Pat. No. 3,941,509 issued to J. E. Gillilan and H. M. Townsend on Mar. 2, 1976 for "Pumping System." In systems such as this, air is compressed in a plurality of storage chambers as a function of water or a similar fluid entering a different chamber. The pressure head of water is thus converted to an air pressure in a plurality of tanks having a much greater volume than the original pressure generating volume. This potential energy in the form of air pressure is then utilized to reduce the pressure across a compressed gas pumping system to reduce the power required for fluid recirculation.

All of the foregoing systems fail to achieve a high efficiency level due to their failure to maximize conservation of materials as well as energy.

OBJECTIVES OF THE INVENTION

It is therefore a primary objective of the present invention to produce useable energy while conserving the fluids utilized to create the energy and the potential energy in the form of fluid pressures to maximize efficiency of the overall system.

Another objective of the present invention is to provide a method for creating energy in a useable form, such as electrical energy, from a flowing fluid under a predetermined pressure head which is maintained by recycling the fluid.

A still further objective of the present invention is to provide a means for recycling fluid to maintain a pressure head through the application of a compressed gas to pumping chambers.

A further objective of the present invention is to compress gas by permitting a fluid to enter pumping chambers filled with a gas and connected to a gas storage tank by a one-way valve means.

A still further objective of the present invention is to provide an energy conservation electrical generating system wherein an electrical generating turbine is driven by water exiting the base of a standpipe.

A still further objective of the present invention is to provide a power generation system wherein pressurized water flowing through a turbine enters pumping chambers and forces air therefrom into a storage tank which in turn is utilized to discharge the pumping chambers when full of fluid so that the discharged fluid is recycled to the top of a standpipe.

It is a still further objective of the present invention to provide an air compressor adapted to boost the air pressure of air exiting pumping chambers in response to fluid entering therein.

SUMMARY

This invention relates to an energy generating system which utilizes a material and energy conservation technique wherein fluid exiting a standpipe drives a turbine and is recycled to the top of the standpipe. The fluid is pumped to the top of the standpipe in the recycling mode by forcing it from pump chambers with compressed air. The compressed air is provided from an air compressor and air storage tank which received a precharge as the pump chambers are initally filled with fluid from the output of the turbine. Thus the fluid driving the power converter or turbine is recycled through the fluid system and pressurized air adapted to recycle the fluid is also recycled by being forced into a storage tank from pump chambers and then selectively returned to the pump chambers to force the fluid to the top of the standpipe. A plurality of servo valves and check valves are incorporated in the fluid and air lines to provide the required flow control.

BRIEF DESCRIPTION OF THE DRAWINGS

The lone drawing FIGURE is a functional schematic drawing depicting the energy producing and material and energy conservation system of the present invention.

DESCRIPTION OF THE PREFERRED EMBODIMENT

The functional schematic diagram schematically represents the apparatus of this invention which is comprised of three basic parts, a fluid pump represented by pump chambers 10, 20 and 30; a standpipe 60 to provide a column of water having a predetermined head; and a power converter 70 which in the preferred embodiment is a turbine driven generator which produces energy as a result of the water weight and mass which flows through it from the standpipe 60.

In this embodiment the water is recirculated at a fraction of the energy cost normally required by standard pumping means since the weight of the column of water is utilized to accomplish most of the work required for recirculation in addition to driving the power converter 70. The system is designed so that the maximum possible flow allowed by the plumbing returning the water to the pump will never be required. This allows the total water pressure head to be applied while refilling the pumping chambers and prevents suction, or loss of the pressure head on the line.

A booster air compressor 50 is provided in the pumping system. Its power requirements are minimal because of the pressure head provided by the standpipe through the pump chambers. The pressure of the column of water from the standpipe 60 assists the air compressor 50 in reclaiming the air in the pump chambers 10, 20 and 30 after each cycle. This creates a situation where the air compressor 50 is never required to pump against a pressure head of more than 5 to 10 PSI while transferring air which is at a pressure many times that value.

The pump functions by selectively admitting water or air to the pump chambers 10, 20 and 30 and selectively allowing air to enter the storage tank 40 from the pump chambers or to enter the pump chambers from the storage tank. This is accomplished by a number of check valves and electrically operated solenoid valves and associated plumbing. The solenoid valves may be operated sequentially by use of a single, electrically driven, rotating cam sequence.

Considering the above general functional description, a method of utilizing the apparatus illustrated in FIG. 1 will now be presented. To fully understand the operation of the system consider the following conditions exist at the beginning of the operating cycle, the standpipe 60 is full of water, the first pump chamber 10 is full of water and solenoid valves 14 and 15 are closed, the second pump chamber 20 is full of air and solenoids 24 and 25 are closed, and the third pump chamber 30 is full of air with solenoids 34 and 35 closed. Electrical energy is applied to the solenoid system and fluid level sensor 16 of pump chamber 10 detects a full chamber and holds solenoid valve 15 closed but opens solenoid valve 14. In pump chamber 20, the fluid level sensor 26 senses an empty chamber and maintains solenoid valve 24 closed but opens solenoid valve 25 to permit air to pass from the chamber to the air compressor 50 through check valve 21. The fluid level sensor 36 of pump chamber 30 maintains solenoid valve 34 closed due to the low fluid sensed signal and opens solenoid air control valve 35 to permit air to flow from the chamber through the check valve 31 into the air compressor 50.

With solenoid valve 14 opened, compressed air in storage tank 40 flows through conduit 41 through the valve and into chamber 10. This forces the water out of the chamber through check valve 13 and into line 61 which carries the water to the top of the standpipe 60. Water flows through the standpipe and into the turbine 70 creating electrical energy. Water exiting the turbine 70 flows through pipe 62 and check valve 22 into the second pumping chamber 20 forcing the air contained therein through solenoid valve 25 and check valve 21 into the air compressor 50 which boosts its pressure and applies it to the air storage tank 40 via conduit 51. A similar function occurs with respect to pump chamber 30 wherein water in pipe 62 passes through check valve 32 and into pump chamber 30 causing the air to flow through open solenoid valve 35 and check valve 31 into the air compressor which boosts its pressure and applies it through conduit 51 to the air storage tank 40.

When the water in pump chamber 10 is depleted, fluid level sensor 16 closes solenoid valve 14 to prevent air from passing through the pump chamber and into fluid line 61. Simultaneously, fluid level sensor 16 opens solenoid valve 15 so that water exiting the converter and flowing in line 62 may enter pump chamber 10 through check valve 12 and force the air in the chamber through solenoid valve 15 and check valve 11 into the air compressor 50 which increases its pressure and passes it via conduit 51 into air storage tank 40.

Simultaneously with the switching of the solenoid valves associated with pump chamber 10, the solenoid valves of pump chamber 20 are sequenced. The fluid level sensor 26 closes the air control solenoid 25 and opens solenoid valve 24 so that pressurized air from the storage tank 40 will flow through conduit 41 and into pump chamber 20, forcing water out of pump chamber 20 through check valve 23 and into the fluid return line 61 to the top of the standpipe 60. Under these conditions pump chamber 30 has been filled and pump chamber 10 is being filled and providing pressurized air to the air compressor 50.

When pump chamber 20 is emptied, the fluid level sensor 26 reverses solenoids 24 and 25 to permit water to enter pump chamber 20 via check valve 22 and allow air to pass out of the chamber via solenoid valve 25 and check valve 21. Simultaneously with the switching of the solenoids 24 and 25 of pump chamber 20, the solenoid control valves 34 and 35 of pump chamber 30 are cycled. This causes solenoid valve 35 to close, preventing air from flowing from the chamber into the air compressor 50 and solenoid valve 34 is opened, permitting compressed air from the storage tank 40 to pass through line 41 and into pump chamber 30. This action causes fluid to exit pump chamber 30 through check valve 33 and enter the return fluid line 61 connected to the top of the standpipe 60. The cycle is then repeated when pump chamber 30 is emptied which triggers the recycling of solenoid valves 14 and 15 associated with pump chamber 10.

The sequencing of the pump chambers is accomplished in a preferred embodiment of the present invention by activating the solenoid valves from a common cam shaft driven by a single electric motor that is incremented sequentially by level sensors 16, 26 and 36 in a step wise fashion. Thus in a simplified version of the system, level sensors 16, 26 and 36 are adapted to sense only a low water level and when they sense such a condition they cause the cam actuating motor to make a single step.

The cam is formed in a preferred embodiment so that each pump chamber is open to the turbine discharge line 62 and air return line 51 during the discharge cycles of all other pump chambers in the system.

While preferred embodiments of this invention have been illustrated and described, variations and modifications may be apparent to those skilled in the art. Therefore, I do not wish to be limited thereto and ask that the scope and breadth of this invention be determined from the claims which follow rather than the above description.

What I claim is:

1. A method of generating power comprising the steps of:

permitting compressed air to enter a first pump chamber filled with water so as to force said water from said chamber into a conduit and therethrough to the top of a standpipe;

permitting water in said standpipe to exit the bottom of said standpipe through a power converter adapted to generate electrical energy;

permitting the water which has passed through said power converter to enter a second pump chamber filled with air to force the air in said second pump chamber into an air conduit;

compressing the air in said air conduit; and coupling the air from an air compressor into an air storage tank.

2. A method as defined in claim 1, wherein the sequence of steps presented is repeated a plurality of times in the sequence presented.

3. A power generating system, comprising:

a fluid reservoir having a fluid inlet and a fluid outlet wherein said fluid outlet is positioned below said fluid inlet to create a head of pressure therebetween;

a power converter adapted to be driven by fluid flowing from said fluid exit;

a first fluid conduit adapted to receive fluid from said fluid reservoir via said power converter;

a second fluid conduit connected to said fluid reservoir input;

an air storage tank;

an air charging conduit connected to said air storage tank;

a pump charging conduit connected to said air storage tank;

a first pump, including a first pump chamber, a first one-way fluid flow means adapted to permit fluid from said first fluid conduit to enter said first pump chamber, a second one-way fluid flow means adapted to permit fluid to exit said first pump chamber and enter said second fluid conduit, a first valve adapted to couple said first pump chamber to said pump charging conduit, a one-way air flow control means, and a seccond valve adapted to permit air from said first pump chamber to pass through said one-way air control valve into said air charging conduit; and a second pump, including a second pump chamber, a first one-way fluid flow means adapted to permit fluid from said first fluid conduit to enter said second pump chamber, a second one-way fluid flow means adapted to permit fluid to exit said second pump chamber and enter said second fluid conduit, a first valve adapted to couple said second pump chamber to said pump charging conduit, a one-way air flow control means, and a second solenoid valve adapted to permit air from said first pump chamber to pass through said one-way air control valve into said air charging conduit.

4. An apparatus as defined in claim 3 further including an air compressor positioned in said air charging conduit between said air storage tank and said pump chamber.

5. An apparatus as defined in claim 4, comprising: a third pump, including a third pump chamber, a first one-way fluid flow means adapted to permit fluid from said first fluid conduit to enter said third pump chamber, a second one-way fluid flow means adapted to permit fluid to exit said third pump chamber and enter said second fluid conduit, a first valve adapted to couple said third pump chamber to said pump charging conduit, a one-way air flow control means, and a second valve adapted to permit air from said first pump chamber to pass through said one-way air control valve into said air charging conduit.

6. An apparatus as defined in claim 5, comprising:

a first fluid level sensor adapted to provide an electrical signal indicative of the fluid level in said first pump chamber with respect to a predetermined minimum value;

a second fluid level sensor adapted to provide an electrical signal indicative of the fluid level in said second pump chamber with respect to a predetermined minimum value;

a third fluid level sensor adapted to provide an electrical signal indicative of the fluid level in said third pump chamber with respect to a predetermined minimum value; and means responsive to said first, second and third fluid level sensors for sequentially controlling said first and second valves.

7. An apparatus as defined in claim 6, wherein said first and second valves are solenoid valves.

8. An apparatus as defined in claim 7, comprising: control means responsive to said fluid level sensors adapted to maintain said sets of pump chamber associated first and second solenoid valves in opposite states and permit at any given time only one of said first solenoid valves to be in an open state.

* * * * *